United States Patent [19]

Thomas et al.

[11] Patent Number: 4,480,753

[45] Date of Patent: Nov. 6, 1984

[54] METAL DETECTOR APPARATUS AND METHOD

[75] Inventors: Joe P. Thomas, Tucker, Ga.; Charles D. Rogers, Springfield, Oreg.; Richard R. Noll; Harry E. Peltzer, both of Eugene, Oreg.; Steven P. Perrine, Cleves, Ohio

[73] Assignee: Metal Detectors, Inc., Eugene, Oreg.

[21] Appl. No.: 57,262

[22] Filed: Jul. 12, 1979

[51] Int. Cl.[3] ..... B07C 5/344

[52] U.S. Cl. ..... 209/546; 209/570; 209/657

[58] Field of Search ..... 209/546, 548, 549, 567, 209/570, 571, 606, 656, 657; 324/204, 214–216, 234, 238, 239, 240; 99/469, 471; 193/2 A, 2 B, 255, 31 R, 31 A; 49/26, 28, 31; 221/21; 137/872, 875, 625.44; 271/303; 198/367, 532

[56] References Cited

U.S. PATENT DOCUMENTS

| | | | |
|---|---|---|---|
| 833,708 | 10/1906 | Downton | 99/469 |
| 1,407,211 | 2/1922 | Miner | 193/2 A |
| 2,062,545 | 12/1936 | Weis . | |
| 2,237,254 | 4/1941 | Broekhuysen | 209/570 X |
| 2,419,750 | 4/1947 | Wiberg . | |
| 2,765,894 | 10/1956 | Craig | 193/2 B |
| 3,006,472 | 10/1961 | Clute . | |
| 3,110,401 | 11/1963 | Way et al. | 209/606 X |
| 3,276,164 | 10/1966 | Hilfing et al. | 49/28 |
| 3,283,899 | 11/1966 | Vedvik et al. | 209/549 |
| 3,467,254 | 9/1969 | Simmons | 209/549 X |
| 4,020,973 | 5/1977 | Hinz | 221/21 X |
| 4,142,636 | 3/1979 | Planke | 209/657 X |
| 4,171,262 | 10/1979 | Lattmann et al. | 209/657 X |

OTHER PUBLICATIONS

*Solid State Industrial Metal Detectors*, ITT Industrial Automation Systems, Jul., 1973.

*Primary Examiner*—Robert B. Reeves
*Assistant Examiner*—Edward M. Wacyra
*Attorney, Agent, or Firm*—Jones & Askew

[57] ABSTRACT

A metal detector system which includes an electromagnetic search coil, a gate for diverting portions of a material stream containing metal detected by the search coil to a reject container, and a coupling for isolating vibrations caused by the gate from the search coil. The metal detector system also includes control circuitry for automatically recycling the gate when an obstruction prevents the gate from returning to its normal standby position. A test circuit is provided to test the search coil by closing a conductive loop passing through the electromagnetic field of the search coil.

7 Claims, 4 Drawing Figures

METAL DETECTOR APPARATUS AND METHOD

TECHNICAL FIELD

The present invention relates to the field of metal detection, and more particularly to metal detectors which utilize an electromagnetic search coil to detect metal passing through the electromagnetic field of the coil.

BACKGROUND OF THE INVENTION

In many industries, such as food processing, non-metallic materials are conveyed automatically to various processing machines. A problem arises in such industries because opportunities arise for "tramp" metal to be introduced into the material stream, and such tramp metal would damage the processing machines if conveyed to the machines along with the non-metallic material.

It is known in the art that the non-metallic material stream can be passed through the electromagnetic field of a search coil, and that if any tramp metal is present in the material stream it will disturb the electromagnetic field of the search coil and induce a detectable error signal in the search coil. Responsive to the error signal, the material stream can either be stopped until the metallic material is removed, or diverted to a waste container for a short period of time.

In one type of prior art search coil device, a stream of non-metallic material is directed vertically through the center of a search coil. The coil is connected to circuitry which automatically operates a hinged gate valve to divert the vertical stream of material into a reject container in response to an error signal from the search coil caused by a piece of tramp metal passing through the search coil. However, we have found that when an attempt is made to substantially enclose the entire stream of non-metallic material and the gate valve, the gate valve strikes against the sides of the enclosure and thereby causes vibrations which are transmitted through the enclosure to the search coil. Such vibrations cause disruption of the electromagnetic field of the search coil which can cause an error signal to be generated when no metal has been detected. This leads to a waste of acceptable material.

Another problem with such metal detection systems has been an inability to conveniently test the search coil to determine whether the coil is operating properly. It has been necessary in prior art systems to actually pass a piece of metal through the field of the coil to see whether it is detected. However, when this is done careful steps must be taken to assure that the test metal is removed whether or not it is detected by the search coil. This is a particular problem in vertical pass detectors such as described above, since the piece of test metal must be dropped through the coil and prevented from dropping vertically into a processing machine that could be damaged by the metal.

Still another problem with an enclosed vertical pass metal detector is that an obstruction, such as a large piece of non-metallic material or a piece of tramp metal, can become trapped between the gate valve and the enclosure. This prevents the gate valve from fully returning to its normal position after cycling to divert rejected material, and therefore allows a substantial amount of acceptable material to pass around the obstruction and into the reject container until the obstruction is released by the next cycling of the gate valve responsive to detection of metal by the search coil.

SUMMARY OF THE INVENTION

The present invention solves the above-described problems in the art by providing a metal detection system which isolates vibrations caused by a gate valve, provides a test circuit which simulates the presence of tramp metal in the field of the search coil to avoid the necessity for actually introducing metal into the material stream to test the search coil, and senses the presence of obstructions blocking the gate valve and cycles the gate valve to release the obstructions.

Generally described, the present invention comprises, in a metal detector apparatus including an electromagnetic search coil disposed to detect metal in a material stream falling through said coil, and a gate responsive to the search coil for diverting the material stream from a primary path to a reject path when metal is detected by the search coil, the improvement of conduit means for substantially enclosing the material stream in the gate, and coupling means in the conduit means located between the search coil and the gate for isolating the search coil from vibrations caused by operation of the gate. Preferably, the coupling means comprises a flexible neoprene sleeve forming a segment of the conduit means.

Generally described, the obstruction clearing means of the metal detector system of the present invention comprises, in a metal detector apparatus including an electromagnetic search coil disposed to detect metal in a material stream falling through the search coil and a reject means responsive to the search coil for cycling a gate from a standby position outside the path of the falling material stream to a reject position wherein said gate diverts said material stream from said path, and subsequently back to said initial position, the improvement of means for sensing the presence of the gate in the standby position, and means, responsive to the gate being absent from the standby position longer than a predetermined period of time, for inducing the reject means to cycle the gate. The means for inducing the reject means to cycle the gate can comprise a means for closing a conductive loop positioned to pass through the electromagnetic field of the search coil, thereby disrupting the electromagnetic field of the search coil and simulating the passage of a piece of tramp metal. Thus, if the gate upon returning toward the standby position traps an obstruction between the gate and the conduit, the gate will again be cycled to free the trapped metal.

A manual switch is provided for arbitrarily closing the conductive loop so that the search coil may be tested without actually introducing metal into the system.

Thus, it is an object of the present invention to provide a metal detector system including an electromagnetic search coil, in which vibrations caused by a means for diverting a material stream are isolated from the search coil.

Another object of the present invention is to provide a metal detector system including an electromagnetic search coil and a means for testing the search coil without introducing metal into the system.

Another object of the present invention is to provide a metal detector system including an electromagnetic search coil, a gate for diverting a material stream into a reject container when tramp metal is detected in the material stream, and a means for inducing the gate to cycle as if metal has been detected when an obstruction is trapped between the gate and the wall of a conduit enclosing the material stream.

Another object of the present invention is to prevent excessive loss of acceptable material in such a metal detector system when an obstruction prevents the gate from fully returning to its standby position after operating to divert rejected material.

Other objects, features and advantages of the present invention will become apparent upon reading the following specification when taken in conjunction with the accompanying drawing.

DETAILED DESCRIPTION

Figure 1:
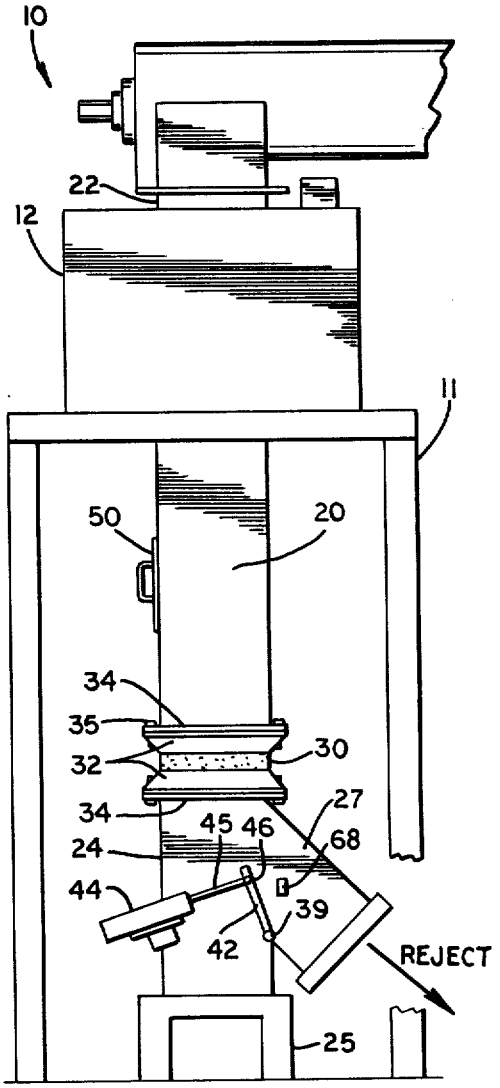
FIG. 1 is a side elevational view of a metal detector system embodying the present invention.
Figure 2:
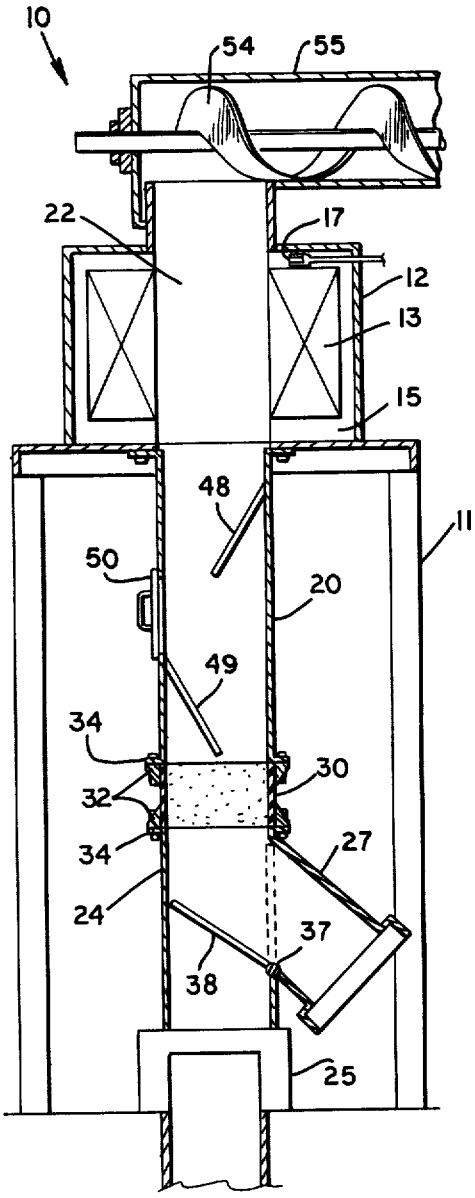
FIG. 2 is a vertical cross sectional view of the metal detector system of FIG. 1.

Referring now in more detail to the drawing, in which like numerals indicate like parts throughout the several views, FIG. 1 shows an elevational view of a metal detector system 10 according to the present invention. The metal detector system 10 includes a main frame 11 on top of which is mounted a search coil assembly 12. The search coil assembly 12, as shown in FIG. 2, includes a search coil 13 which comprises windings of conductive wire around an open core. The coil 13 is potted in a refractory material 15 in order to stabilize the coil. A test coil 17 comprising a small number of turns of wire is potted into the refractory material adjacent to and immediately above the search coil 13. The test coil 17 is connected to a control circuit to be described hereinafter.

Suspended from the main frame 11 directly below the vertically aligned open core of the search coil 13 is a central conduit member 20, which has a square horizontal cross section. Above the central conduit member 20 and extending through the open core of the search coil 13 is an upper conduit member 22. Aligned below the central conduit member 20 and mounted on a base 25 is a lower conduit member 24. A downwardly reclined reject conduit 27 is attached to one side of the lower conduit member 24 and is in communication therewith.

The central and lower conduit members are connected by a coupling means 30 comprising a sleeve made of neoprene or another suitable flexible material that will not transmit vibrations from the lower conduit member to the central conduit member and the search coil assembly 12. The neoprene sleeve 30 at its upper and lower openings is glued to the interior surface of a pair of square brackets 32. The brackets and sleeve are then moved into place between the central and lower conduit members, and the brackets 32 are each bolted to one of a pair of flanges 34 by means of bolts 35. As will be seen from the drawing, one of the flanges 34 is formed at the lower end of the central conduit member 20 and the other bracket 34 is formed in the upper end of the lower conduit member 24.

Within the lower conduit 24, an axle 39 is rotatably mounted across the lower conduit member 24 at the bottom of the opening between the lower conduit member 24 and the reject conduit 27. Rigidly fixed to the axle 39 is a gate 38 which extends outwardly from the axle 39 a distance equal to the height of the opening between the lower conduit member 24 and the reject conduit 27. The axle 39 extends outside of the lower conduit member 24 and is rigidly attached to an arm 42 outside the conduit. By means of a pneumatic cylinder 44, the arms 42 is moved about the axis of the axle 39. This movement is accomplished by means of a piston rod 45 extending from the pneumatic cylinder 44 and pivotally connected to the arm 42 at a pivot link 46. It will thus be seen that as the arm 42 rotates outside the lower conduit member 24, the gate 38 rotates through a similar arc inside the conduit member 24. The travel of the piston rod 45 is selected so that the gate 38 travels between two positions, a normal or standby position (shown in dashed lines in FIG. 2) wherein a stream of material passing vertically through the lower conduit member 24 continues to pass vertically into a machine (not shown) located below the metal detector system 10, and a reject position (shown in solid lines in FIG. 2) wherein the stream of material is diverted into the reject conduit 27. The gate 38 is shaped so as to substantially completely block the lower conduit member 24 when the gate is in its reject position.

A normally closed limit switch 68 is mounted outside the lower conduit member 24 in the path of the arm 42, so that the arm 42 engages and opens the limit switch 68 only when the piston rod 45 is fully extended and the arm 42 and connected gate 38 are rotated to their furthest clockwise position. That is, the limit switch 68 is opened when the gate 38 is in its standby position. The limit switch 68 is part of the control circuitry to be described hereinafter.

As shown in FIG. 2, a pair of downwardly inclined baffles 48 and 49 are located along the central conduit member 20. The purpose of the baffles 48 and 49 is to slow the speed of the stream of material falling through the central conduit member 20 between the search coil assembly 12 and the gate 38. The central conduit member 20 also includes an inspection port 50 in the side of the conduit member 20.

In the embodiment shown in FIGS. 1 and 2, material is delivered to the metal detector apparatus 10 by an auger conveyor 54 enclosed within a conveyor housing 55, which communicates with the top of the upper conduit member 22. It will be understood that any conveyor means suitable for handling the particular material that is to be passed through the metal detector system 10 may be utilized, such as, for example a belt conveyor or a bucket conveyor or a pneumatic conveyor.

Figures 3, 4:
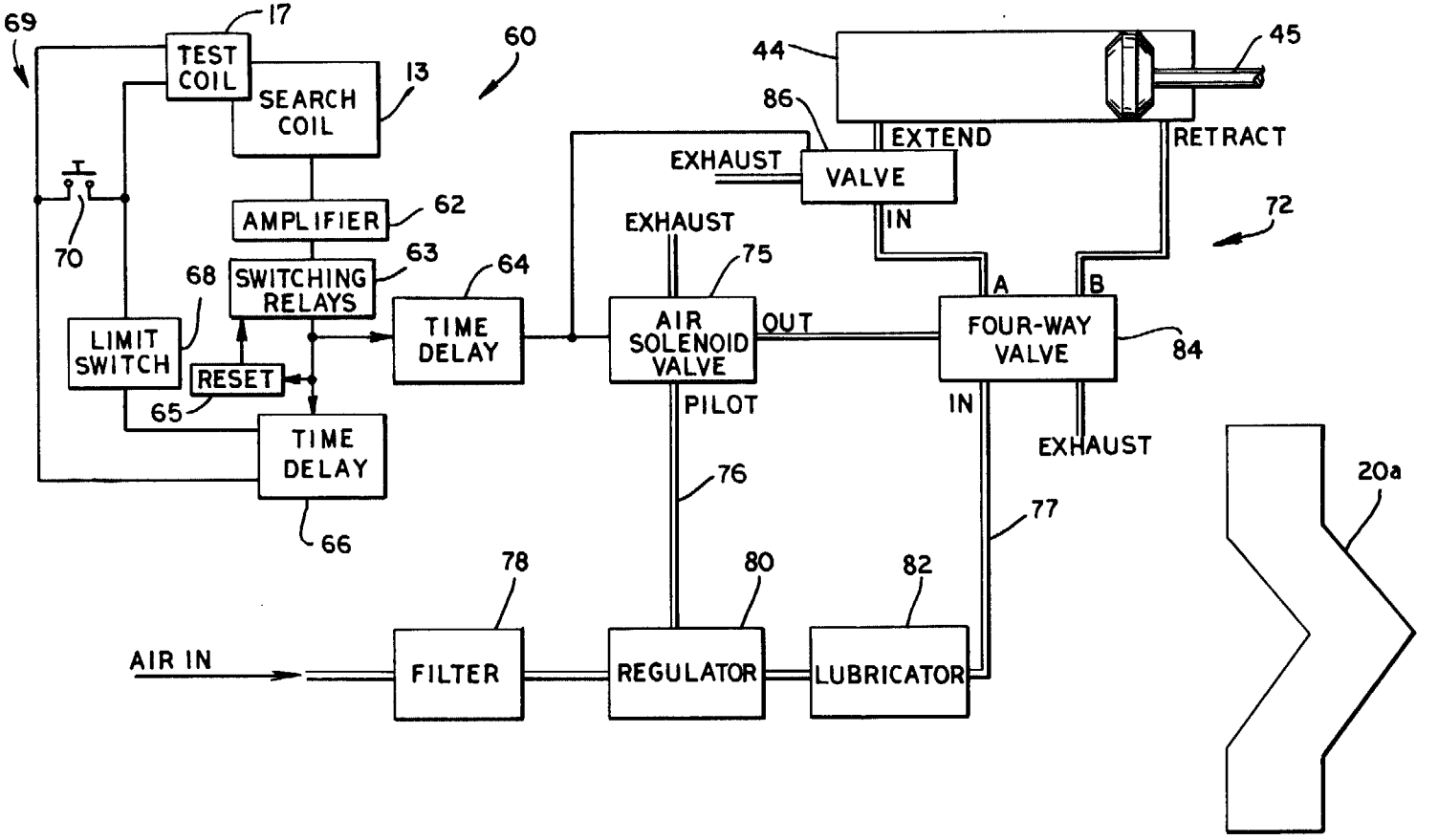
FIG. 3 is a diagrammatic representation of electrical and pneumatic circuits for operating the metal detector system shown in FIG. 1.
FIG. 4 is a side elevational view of an alternate embodiment of the central conduit member of the metal detector system shown in FIG. 1.

FIG. 3 is a diagrammatic representation of an electrical control circuit 60 and a pneumatic control circuit 72 which operate the metal detector system 10 of the present invention. In the electrical control circuit 60, the search coil 13 is connected to an amplifier 62 which amplifies the error signal generated by the search coil 13 when a piece of tramp metal is detected. The amplifier signal is transmitted to a set of switching relays 63 which energize the other elements of the circuit 60. Those skilled in the art will understand that the switching relays can include a meter relay, such as an Assembly Products Model 31-3602-2501 relay, for transmitting the amplified error signal when it exceeds a predetermined strength. The sensitivity of the metal detector system can be adjusted by adjusting the value at which the meter relay transmits the signal. The meter relay can be connected to a plug-in relay such as a Guardian Model 1215-3C-10, which upon being triggered by the meter relay, energizes two time delay circuits 64 and 66. The time delay circuits 64 and 66 are both of the type well known to those skilled in the art which disconnect a normally closed circuit for a predetermined period of time following receipt of a triggering signal from the switching relays. The time delay circuits 64 and 66 can be, for example, Allen Bradley 849A-ZOD24, Series B, off-delay operation relays, which are pneumatic relays that are momentarily energized to open relay contacts that close after air has escaped from a pressurized chamber. The time delay during which the contacts are open can be controlled by adjusting the orifice through which the air escapes.

The signal from the switching relays 63 can also be provided to a reset circuit 65, which resets the switching relays after a very short time delay, in a manner known to those skilled in the art.

The leads of the test coil 17 are connected in series with the limit switch 68 and the contacts of the time delay circuit 66, to form a test loop 69. A push-button test switch 70 is connected across the test loop 69 in parallel with the limit switch 68 and relay 66. As will be described in more detail hereinafter, the test loop 69 can be automatically or manually closed or opened, but no current is externally driven through the test loop 69.

The time delay circuit 64 is connected to an electrically controlled air solenoid valve 75, which is an element of the pneumatic control circuit 72, the purpose of which is to operate the penumatic cylinder 44 which cycles the gate 38. Air pressure to operate the pneumatic control circuit 72 is provided by a normal industrial compressor (not shown) commonly found in plants and factories. The line air pressure passes through a filter 78, a regulator 80 and a lubricator 82, in a manner well known to those skilled in the art. A pilot air line 76 extends from the regulator 80 to a PILOT port of the air solenoid valve 75. In its normal electrical state, the valve 75 directs the pilot air stream to an EXHAUST port of the valve 75. An OUT port of the valve 75 is connected to a four-way air valve 84 and operates the valve 84 to change positions when pressure is communicated from the valve 75 to the valve 84. The four-way valve 84 is connected to the lubricator 82 at an IN port by a main air line 77. The four-way valve 84 includes three output ports, an EXHAUST port, an A port connected to an EXTEND port of the pneumatic cylinder 44, and a B port connected to a RETRACT port of the pneumatic cylinder 44, the EXTEND and RETRACT ports of the pneumatic cylinder 44 being located on opposite sides of the piston. In the air line between the A port of the four-way valve 84 and the EXTEND port of the pneumatic cylinder 44 is located an electrically controlled exhaust valve 86 having an IN port and an EXHAUST port and being selectively operative to permit rapid exhaust of the pneumatic cylinder 44 when pressure is applied to retract the piston rod 45. In its normal electrical state the valve 86 connects the IN port of the valve 86 with the EXTEND port of the cylinder 44.

A preferred embodiment of a central conduit member 20*a* is shown in FIG. 4. In the preferred embodiment, the central conduit member 20*a* includes no baffles inside the conduit. Instead, the central conduit member is shaped to bend away from the vertical path of the material stream and then to bend back to restore the vertical path of the stream immediately above the lower conduit member 24. The advantage of the central conduit member 20*a* over the use of baffles is that the speed of the falling material stream can be slowed without reducing the cross sectional area of the conduit as is the case when baffles are placed within the conduit. Therefore the preferred embodiment shown in FIG. 4 can handle a larger volume of material while accomplishing the same speed reduction function.

The operation of the metal detector system 10 according to the present invention can be explained by reference to FIGS. 1-3. Initially, power supplies (not shown) connected to the search coil and electrical control circuitry are turned on, and the pneumatic control circuit is connected to an air supply. In order to test the effectiveness of the search coil 13 prior to use, an operator can merely depress the push-button switch 70, which can be located in a control panel remote from the search coil itself. The effect of depressing the push-button 70 is to create a closed conductive loop, a portion of which passes through the electromagnetic field of the search coil 13. The test coil 17 forms the portion of the loop thus passing through the electromagnetic field. The closing of the test loop 69 causes a disruption of the electromagnetic field of the search coil 13 and creates an error signal similar to that generated when a piece of metal falls through the electromagnetic field of the search coil 13. Thus, the test coil 17 and push-button 70 provide a means for testing the search coil 13 without introducing into the system a piece of tramp metal which might not be recovered if the search coil 13 is in fact inoperative.

After testing of the search coil 13, the auger 54 is rotated in order to deliver the non-metallic material stream to the top of the upper conduit member 22. The material stream falls freely through the conduit within the core of the search coil 13, so that any metal within the material stream will disrupt the electromagnetic field of the search coil 13 and generate an error signal. When this occurs, the error signal is amplified by the amplifier 62 and the time delay circuit 64 is energized to open its contacts thereby changing the electrical state of the air solenoid valve 75. At this time the solenoid valve 75 is switched to direct the pilot air stream entering from the line 76 from the EXHAUST port of the solenoid valve 75 to the OUT port of the valve.

Prior to switching of the valve 75, the four-way valve 84 is in its normal position wherein the main air pressure along line 77 is directed from the IN port of the valve 84 to the A port so that the pneumatic cylinder 44 is pressurized normally through the EXTEND port and the piston rod 45 is extended out of the cylinder 44 to hold the gate 38 in its standby position wherein it blocks the reject conduit 27 and guides the material stream in a vertical path out the bottom of the metal detector system 10 and into a machine for processing the material (not shown). The pilot air pressure from the air solenoid valve 75 switches the four-way valve 84 to direct the main air pressure from the IN port to the B port and thence to the RETRACT port of the pneumatic cylinder 44. The opening of the contacts of the time delay 64 also changes the electrical state of the exhaust valve 86 to switch the valve to connect the EXTEND port of the pneumatic cylinder 44 to the EXHAUST port of the valve 86 in order to permit rapid exhaust of the cylinder 44.

The foregoing redirection of pneumatic pressure results in the gate 38 being rapidly cycled from its standby position shown in dashed lines in FIG. 2, to its reject position shown in solid lines in FIG. 2. A rotation of the gate valve to its reject position occurs prior to the time that the portion of the material stream carrying the metal which tripped the search coil reaches the gate 38. Thus, the metal and a small portion of the material stream is directed through the reject conduit 27 into a waste container (not shown).

When the gate 38 is rapidly thrown into its reject position or returned to its standby position, it impacts against the wall of the lower conduit member 24, causing the lower conduit member 24 to vibrate. Such vibration, if transmitted by the central and upper conduit members to the search coil 13, would often disrupt the electromagnetic field of the search coil 13 and cause a false error signal to be generated. The neoprene sleeve 30, however, prevents the vibrations of the lower conduit member 24 from being transmitted upwardly to the search coil 13, and therefore renders the metal detection system 10 substantially more accurate and dependable.

The predetermined time delay of the time delay circuit 64 is adjustable, as described above, and is preferably set at approximately one second. At the end of the predetermined time period, the contacts of the time delay circuit 64 close, and the air solenoid valve 75 returns to its normal electrical state and switches the pilot air stream back to its EXHAUST port. Also, the four-way valve 84, in the absence of the pilot air pressure, switches back to its normal position wherein the IN port is connected to the A port, and the exhaust valve 86 returns to its normal electrical state and switches back to its normal position wherein the IN port is connected to the EXTEND port of the pneumatic cylinder 44. At this time the main line air pressure enters the EXTEND port of the pneumatic cylinder 44 and thrusts the piston rod 45 out of the pneumatic cylinder 44. The air within the cylinder 44 is exhausted through the RETRACT port and passes into the B port of the four-way valve 84 which is connected to the EXHAUST port of the valve 84. The extension of the piston rod 45 rotates the gate valve 38 back to its vertical stand-by position, after the portion of the material stream containing the tramp metal has passed into the reject conduit 27.

The orifice of the EXHAUST port of the valve 84 can be made adjustable to permit adjustment of the speed at which the piston rod 45 is extended. By slowing the return of the piston rod 45, the chances of an obstruction being trapped by the returning gate 38 against the side of the conduit member 24 are reduced.

The limit switch 68 is a normally closed switch that is connected in series in the test loop 69. If the gate 38 operates properly and fully returns to its standby position, the gate 38 engages and opens the limit switch 68, thereby providing a break in the conductive loop of the test loop 69. However, if a piece of tramp metal or other obstruction becomes trapped between the edge of the gate 38 and the conduit walls, the gate 38 will not open the limit switch 68.

The test loop 69 also includes the normally closed contacts of the time delay circuit 66. When tramp metal is detected by the search coil 13, the amplified error signal triggers the switching relays 63 which energize the time delay circuit 66, opening the contacts of the time delay circuit 66 for a predetermined interval. The predetermined time interval of the time delay circuit 66 is selected to time out after the gate 38 should have returned to the standby position after cycling to its reject position following the detection of the metal by the search coil 13. The contacts of the time delay circuit 66 close after its time interval has expired, and if the gate 38 has in fact returned to its standby position, the limit switch 68 will have been opened and the closing of the contacts will have no effect. However, if a piece of tramp metal or other obstruction has been caught between the gate 38 and the walls of the conduit, the limit switch 68 will remain closed, and the closing of the contacts of the time delay circuit 66 will complete the conductive test loop 69. Since the test coil 17 is within the electromagnetic field of the search coil 13, the search coil 13 will sense the closing of the test loop 69 and generate an error signal in the same manner as when the manual push-button 70 is depressed. Since the switching relays 63 have been reset by the reset circuit 65 within a fraction of a second after the initial tripping of the search coil by tramp metal, this induced error signal will be processed by the control circuit 60 and will cause the gate 38 to cycle in a normal fashion, resulting in release of the trapped obstruction. The control circuit of the present invention therefore prevents a situation in which acceptable material would escape into the reject conduit 27 through an opening caused by an obstruction preventing the gate from fully returning to its standby position.

While this invention has been described in detail with particular reference to preferred embodiments thereof, it will be understood that variations and modifications can be effected within the spirit and the scope of the invention as described hereinbefore and as defined in the appended claims.

We claim:

1. In a metal detector apparatus including an electromagnetic search coil disposed to detect metal in a material stream falling through said search coil and a reject means responsive to said search coil for cycling a gate from a standby position outside the path of said falling material stream to a reject position wherein said gate diverts said material stream from said path, and subsequently back to said standby position, the improvement comprising:

means for sensing the presence of said gate in said standby position; and means, responsive to said gate being absent from said standby position longer than a predetermined period of time, for inducing said reject means to cycle said gate.

2. The apparatus of claim 1, wherein said means for inducing said reject means to cycle said gate comprises a means for closing a conductive loop positioned to pass through the electromagnetic field of said search coil.

3. The apparatus of claim 2 wherein said conductive loop includes a coil mounted adjacent to said search coil.

4. The apparatus of claim 1 further comprising a conduit means for substantially enclosing said material stream and said gate; and a coupling means in said conduit means located between said search coil and said gate for isolating said search coil from vibrations caused by operation of said reject means.

5. The apparatus of claim 1 further comprising a means for adjusting the speed at which said reject means moves said gate from said reject position back to said standby position.

6. In a method of detecting metal in a material stream including passing said stream through an electromagnetic search coil, and, responsive to detection of metal by said search coil cycling a gate from a standby position to a reject position, to divert said material stream to a reject container, and back to said standby position, the improvement comprising the steps of:

sensing the presence of said gate in said standby position; and responsive to said gate being absent from standby position longer than a predetermined period of time, cycling said gate.

7. In a metal detector apparatus including an electromagnetic search coil disposed to detect metal in a material stream passing through said search coil and a reject means responsive to said search coil for cycling a gate from a standby position outside the path of said material stream to a reject position wherein said gate diverts said material stream from said path, and subsequently back to said standby position, the improvement comprising:

means for sensing the presence of said gate in said standby position; and means, responsive to said gate being absent from said standby position longer than a prdetermined period of time, for inducing said reject means to cycle said gate.

* * * * *